US006321491B1

(12) United States Patent
DiMauro

(10) Patent No.: US 6,321,491 B1
(45) Date of Patent: Nov. 27, 2001

(54) BULKHEAD DOOR SEAL

(75) Inventor: Ronald F. DiMauro, 144 Beacon Ave., Jamestown, RI (US) 02835

(73) Assignee: Ronald F. DiMauro, Newport, RI (US)

( * ) Notice: Subject to any disclaimer, the term of this patent is extended or adjusted under 35 U.S.C. 154(b) by 0 days.

(21) Appl. No.: 09/232,077

(22) Filed: Jan. 15, 1999

(51) Int. Cl.[7] ..... E04B 1/66

(52) U.S. Cl. ..... 52/20; 52/247; 52/21; 52/169.6; 52/107

(58) Field of Search ..... 52/20, 21, 169.14, 52/169.6, 200, 211, 107, 741.4, 101, 214, 204.55, 204.69, 796.04, 393, 292, 293.3, 247

(56) References Cited

U.S. PATENT DOCUMENTS

| | | | | |
|---|---|---|---|---|
| 2,482,170 | * | 9/1949 | Gunnison | 52/204.4 |
| 2,832,614 | * | 4/1958 | Settle, Jr. | 52/720.1 |
| 3,065,572 | * | 11/1962 | Weingartner | 52/20 |
| 3,123,868 | * | 3/1964 | Gust | 52/107 |
| 3,423,264 | * | 1/1969 | Miron et al. | 52/247 |
| 3,938,284 | * | 2/1976 | Broadbent et al. | 52/169.6 X |
| 3,974,599 | * | 8/1976 | Grosh | 52/20 |
| 4,068,777 | * | 1/1978 | Humphrey et al. | 220/1 B |
| 4,196,657 | * | 4/1980 | Crongeyer et al. | 52/20 X |
| 4,208,849 | * | 6/1980 | Lamb | 52/171 |
| 4,287,691 | * | 9/1981 | Guenther | 52/97 |
| 4,372,094 | * | 2/1983 | Boschetti | 52/741 |
| 4,488,791 | * | 12/1984 | Hinchliffe | 52/200 X |
| 4,492,062 | * | 1/1985 | Levenez | 52/97 |
| 4,555,882 | * | 12/1985 | Moffitt et al. | 52/204 |
| 4,602,463 | * | 7/1986 | Holowatyj | 52/197 |
| 4,683,692 | * | 8/1987 | Tetschner | 52/169.11 |
| 4,726,707 | * | 2/1988 | Newton | 52/20 |
| 4,781,008 | | 11/1988 | Lyons, Jr. | 52/656 |
| 5,201,151 | * | 4/1993 | LeBlanc et al. | 52/20 |
| 5,243,799 | * | 9/1993 | Schliter | 52/282.1 |
| 5,312,202 | * | 5/1994 | Newton | 52/20 |
| 5,428,926 | * | 7/1995 | Melfi | 52/71 |
| 5,600,921 | | 2/1997 | Vardaro | 49/380 |
| 5,752,348 | * | 5/1998 | Pearson | 52/169.6 X |
| 5,809,731 | | 9/1998 | Reiss | 52/533 |
| 5,960,596 | * | 10/1999 | Lysons, Sr. | 52/200 |
| 6,119,429 | * | 9/2000 | Bifano et al. | 52/720.1 |

FOREIGN PATENT DOCUMENTS

| | | | | |
|---|---|---|---|---|
| 2122671 | * | 1/1984 | (GB) | 52/20 |

* cited by examiner

*Primary Examiner*—Carl D. Friedman
(74) *Attorney, Agent, or Firm*—Taylor Russell & Russell, P.C.

(57) ABSTRACT

A bulkhead door seal is a sealing device that provides effective sealing of the interface between a bulkhead door assembly and a top of a concrete foundation wall to which it is attached. It prevents air and water from intruding into basement spaces around the bulkhead door assembly. The present invention is made of a flexible material that is very durable in all types of climates and will not break down over time. It is positioned between the bulkhead door assembly mounting flange and the top of the foundation wall. It may be configured with an inner vertical lip so that driving rain will not enter the interior of the door assembly, a flat mounting surface to accept a door assembly mounting flange, and a sloping exterior surface to shed water off the foundation wall. The device may be manufactured in strips that are cut on the building site to custom fit the bulkhead and door assembly.

13 Claims, 7 Drawing Sheets

BULKHEAD DOOR SEAL

BACKGROUND

The invention relates generally to watertight and airtight seals and, more particularly, to a sealing device for use at the interface of a bulkhead door assembly and a concrete foundation wall.

Basement or cellar doors have a long history of use for providing means for accessing a basement or cellar of a dwelling structure from the outside by way of a set of stairs. Since these basement or cellar spaces beneath the dwelling structure are located wholly or partly below ground level, they were usually damp and seldom occupied as living spaces. As such, there was generally not a requirement for eliminating air and water seepage around the edges of the door or where the door attached to the foundation wall of the dwelling structure.

Through the use of modem construction techniques, basements have been made more habitable by eliminating moisture incursion from the surrounding soil and reducing the loss of heat. This improvement enabled the use of basement spaces for additional living space, and typically provided for bedrooms and recreation areas. Furthermore, it is very economical to finish off these spaces. These "finished" basement spaces are normally accessed from the inside of the dwelling. However, most state building codes require that a second means of egress be provided from a basement in case of a fire. Today, approximately 90% of new homes built with a basement have bulkheads that are covered by a bulkhead door assembly. These bulkhead door assemblies are usually fabricated from sheet metal and have flanges that are between 1¼ and 1½ inches wide for attaching the door assemblies to a top of a foundation wall.

Bulkhead door assemblies are prone to air and water leaks into the basements they are supposed to protect. The air and moisture causes damage to the door assembly and to the framing and structure of the house to which it is attached. The resulting problems include mold, mildew, and decay of the insulation and wood framing, as well as rust deterioration to the bulkhead door assembly itself. These problems often result from the manner in which the bulkhead door assembly is affixed to a foundation wall. The metal bulkhead door assembly is attached directly to the top of a concrete foundation wall by an attaching flange and is usually bolted down tight. The typical residential foundation wall is 10 inches thick, with about 6½ inches of level concrete wall top exposed to weather on the outside of the door assembly. Because the top of the foundation wall is flat or concave, when it rains, the water sits on the top of the wall and wicks between the concrete and the metal bulkhead door assembly into the basement. Driving rain further enhances the water leakage, which usually occurs more on the front section than on the sides of the door assembly.

It is possible to partly solve the problem of water leakage around a bulkhead door assembly by sloping the top of the concrete wall away from the bulkhead mounting flange so that water would tend to drain off the top of the foundation wall. This is not a common practice because of the difficulty and expense of providing the slope at the desired location. Another proposed solution to the leakage problem is to apply a sealant, such as silicone, to the edges of the bulkhead door assembly attaching flange to prevent air and water leakage. This solution is only temporary because the metal door attaching flange expands and contracts with temperature excursions while the foundation wall retains essentially constant dimensions. This movement eventually causes the sealant to pull away from the metal attaching flange, creating a void in the interface allowing water and air to enter. The problem is compounded in colder climates where the water that has entered freezes, causing the void in the sealant to enlarge and allow more air and water to enter. Another problem is that the top of the concrete foundation wall is uneven and not perfectly straight and level. Thus, when the flat metal of the attaching flange is placed over the uneven concrete surface, there are numerous voids between the metal flange and the concrete. These voids allow water and air to enter into the inside of the bulkhead door assembly. Therefore, the leakage problem associated with basement door assemblies has become an important issue in finished basement spaces in modem house construction.

For the foregoing reasons, there is a need, therefore for a sealing device that allows a means for effectively sealing the interface between the mounting flange of a bulkhead door assembly and the top of a concrete foundation wall to which it is attached, in order to prevent air and water from intruding into basement spaces. This device must be inexpensive to manufacture, and must be capable of being easily installed at the construction site.

SUMMARY

The present invention is directed to a device that satisfies these needs. The present invention provides for a sealing device that allows a means for effectively sealing the interface between the mounting flange of a bulkhead door assembly and the top of a concrete foundation wall to which it is attached, in order to prevent air and water from intruding into basement spaces. This device is inexpensive to manufacture, and is capable of being easily installed at the construction site.

The present invention is a manufactured sealing strip made from a flexible material, like silicone or neoprene rubber, that is very durable in all types of climates and will not break down over time. It is positioned between the bulkhead door assembly mounting flange and the top of the concrete foundation wall. The device is configured to have a cross section that may have an inner lip so that driving rain will not enter the interior of the bulkhead door assembly, a flat portion on which the metal bulkhead door mounting flange can be positioned, and a sloping surface on the outside of the door assembly to shed water off the top of the concrete wall. The device is manufactured in straight strips and can be cut at the building site to custom fit any bulkhead and door assembly. It is not only capable of providing an air tight and water tight seal when fastened down to the top of the foundation wall, but it also sheds water due to the external sloping configuration.

A device having features of the present invention comprises an elongated strip of semi-flexible material having a top surface, a bottom surface, and a thickness, the bottom surface being substantially flat for being adhesively attached to a top of a concrete foundation wall, the top surface having a shape for mating with a side bottom flange and a front channel of a bulkhead door assembly, and the thickness being compressed when the side bottom flange and the front channel is secured by an attachment means to the foundation wall. The elongated strip may be cut to predetermined lengths to match the perimeter dimensions of the side bottom flanges and the front channel of the bulkhead door assembly. Mitered comers may be formed where cut ends of the elongated strips meet at right angles. The formed mitered comers may be sealed with an seal adhesive. The elongated strip may have a width dimension that is substantially less than a width dimension of the foundation wall. The elongated strip may have a width dimension that is approximately equal to a width dimension of the foundation wall. The elongated strip may have a width dimension that is greater than a width dimension of the foundation wall for providing a drip edge that extends beyond the edge of the foundation wall. The adhesive attachment of the bottom surface to the top of the foundation wall may form an airtight and watertight seal. The top surface may have a flat surface for mating with the side bottom flange and the front channel of the bulkhead door assembly. The top surface may be flexibly mated with the side bottom flange and the front channel of the bulkhead door assembly. The mating of the side bottom flange and the front channel may form an airtight and a watertight seal. The shape of the top surface may include a vertical lip interior to the side bottom flange and front channel for blocking moisture seepage. The shape of the top surface may include a downward sloping surface exterior to the side bottom flange and front channel for draining moisture away from the bulkhead door assembly. The top surface for mating with the side bottom flange and the front channel may be recessed from the top of the downward sloping surface. The attachment means may be an expansion bolt.

In an alternate embodiment of the invention, a seal for a bulkhead door assembly comprises an elongated strip of semi-flexible material having a top surface, at least one side surface, a bottom surface, and a thickness, the top surface and side surface comprising a hard outer shell of the elongated strip, the interior and bottom surface of the elongated strip comprising a soft inner material, the top surface having a shape for mating with a side bottom flange and a front channel of a bulkhead door assembly, the bottom surface being substantially flat for being adhesively attached to a top of a concrete foundation wall, and the thickness being compressed when the side bottom flange and the front channel is secured by an attachment means to the foundation wall. The elongated strip may have a width dimension that is approximately equal to a width dimension of the foundation wall. The elongated strip may have a width dimension that is greater than a width dimension of the foundation wall for providing a drip edge that extends beyond the edge of the foundation wall. The adhesive attachment of the bottom surface to the top of the foundation wall may form an airtight and watertight seal. The top surface may have a flat surface for mating with the side bottom flange and the front channel of the bulkhead door assembly. The mating of the side bottom flange and the front channel may form an airtight and a watertight seal. The shape of the top surface may include a vertical lip interior to the side bottom flange and front channel for blocking moisture seepage. The shape of the top surface may include a downward sloping surface exterior to the side bottom flange and front channel for draining moisture away from the bulkhead door assembly. The top surface for mating with the side bottom flange and the front channel may be recessed from the top of the downward sloping surface.

In an alternate embodiment of the invention, a method for installing a seal for a bulkhead door assembly comprises cleaning a top of a concrete foundation wall, applying an adhesive to the top of the foundation wall, positioning a flat bottom of precut lengths of a bulkhead door seal on the adhesive, mounting a bulkhead door assembly on a top of the precut lengths of the bulkhead door seal, the top having a mounting surface for accepting the bulkhead door assembly, and securing the bulkhead door assembly to the foundation wall by attachment means. The precut length of the bulkhead door seal may be formed by measuring the concrete wall length dimension and cutting the door seal to the length dimension. The comer ends of the precut lengths of bulkhead door seal may be mitered and sealed to form a water tight connection. The method may further comprise providing comer adhesive strips for tighter comer connections between the ends of the precut lengths of bulkhead door seal. The attachment means may comprise forming holes in the seal and concrete wall at predetermined locations, and installing expansion bolts to compress the bulkhead door seal to form an airtight and watertight seal.

The present invention provides for a sealing device that allows a means for effectively sealing the interface between the mounting flange of a bulkhead door assembly and the top of a concrete foundation wall to which it is attached, in order to prevent air and water from intruding into basement spaces. This device is inexpensive to manufacture, and is capable of being easily installed at the construction site.

BRIEF DESCRIPTION OF THE DRAWINGS

These and other features, aspects, and advantages of the present invention will become better understood with regard to the following description, appended claims, and accompanying drawings where:

DETAILED DESCRIPTION

Figure 1:
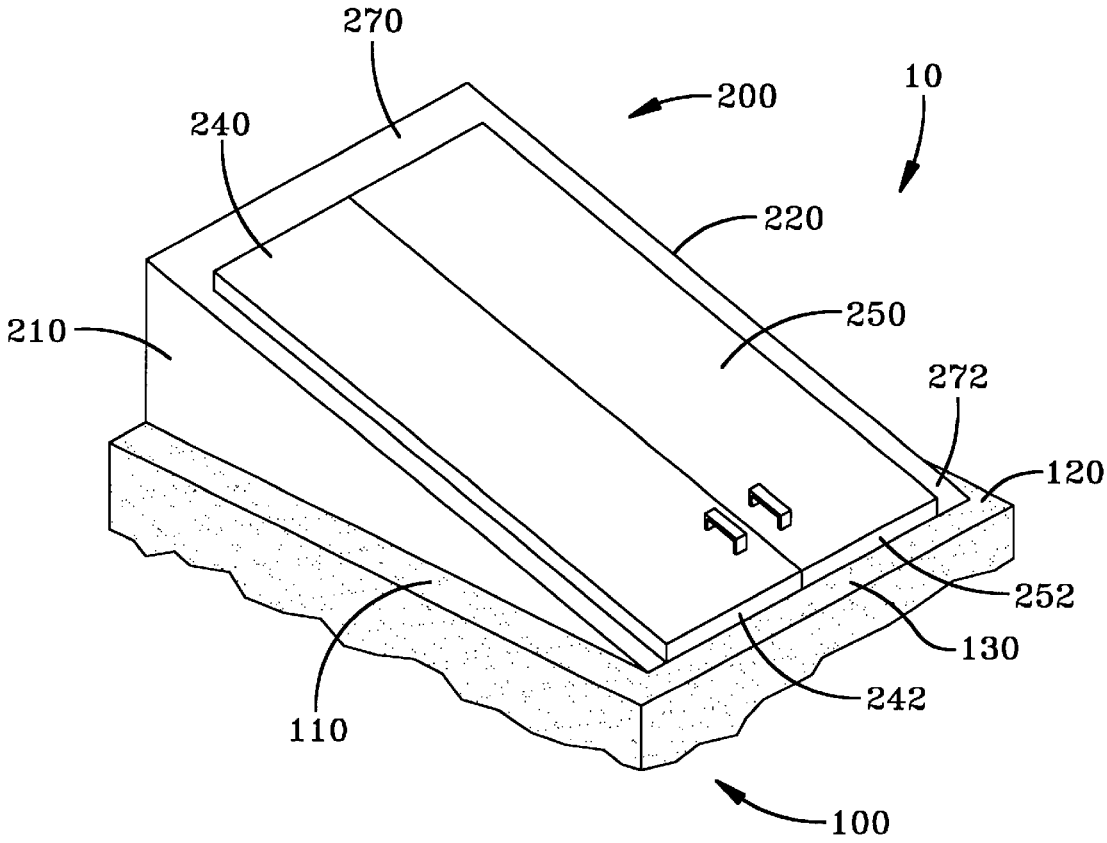
FIG-1 PRIOR ART
FIG. 1 shows an installation of a bulkhead door assembly attached to a concrete foundation wall that is typical of the existing building arts.

Turning now to FIG. 1, FIG. 1 shows an installation 10 of a bulkhead door assembly 200 attached to a concrete foundation wall 100 that is typical of the existing building arts. The bulkhead door assembly 200 is usually fabricated of sheet steel and comprises a left side 210, a top side 270 and a right side 220. The top side 270 slopes downward to a top front 272, and has a left door 240 and a right door 250 rotatably attached to it by hinges positioned towards the sides 210, 220. The left door 240 and the right door 250 are shown in the closed position. The left door 240 has a left door front 242 and the right door 250 has a right door front 252. The foundation wall 100 comprises a left wall 110, a front wall 130, and a right wall 120.

Figure 2A:
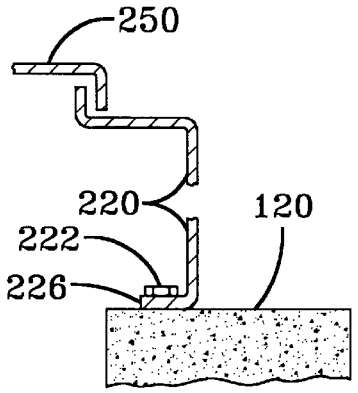
FIG-2A PRIOR ART
FIG. 2A through FIG. 2C show sectional views of the attachment of bulkhead door assemblies to a concrete foundation wall that is typical of the existing building arts.
Figure 2B:
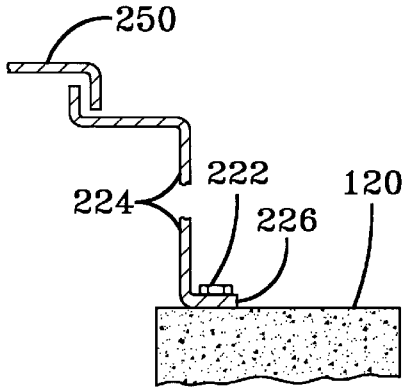
FIG-2B PRIOR ART
Figure 2C:
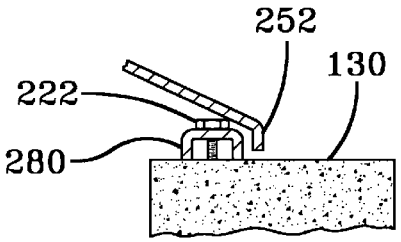
FIG-2C PRIOR ART

Turning now to FIG. 2A through FIG. 2C, FIG. 2A through FIG. 2C show sectional views of the attachment of bulkhead door assemblies to a concrete foundation wall that is typical of the existing building arts. FIG. 2A illustrates the right side 220 and the door 250 of the bulkhead door assembly 200 shown in FIG. 1. A side bottom flange 226 is provided for attaching the bulkhead door assembly to the foundation wall 120. The right side 220 of the door assembly is attached to the right foundation wall 120 by bolts 222 through the side bottom flange 226 located internal to the door assembly. The bulkhead door assembly left side is similarly attached to the left foundation wall. FIG. 2B illustrates the right side 224, the side bottom flange 226 and door 250 of another type of bulkhead door assembly that has attachment means external to the bulkhead door assembly. The right side 224 is attached to the right foundation wall 120 by bolts 222 through the side bottom flange 226 located external to the door assembly. The bulkhead door assembly left side is similarly attached to the left foundation wall. FIG. 2C illustrates the front part of a bulkhead door assembly. A front channel 280 that connects the left side to the right side of the door assembly is attached to the front foundation wall 130 by bolts 222. Also illustrated in FIG. 2C is a partial section of the right door front 252 shown in the closed position.

Figure 3A:
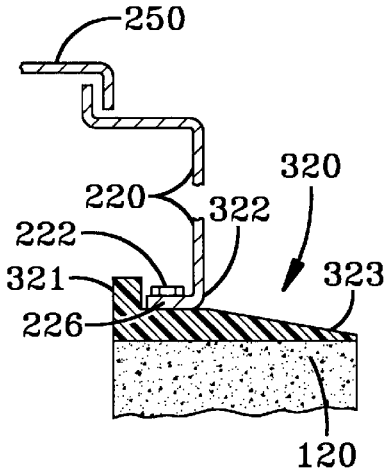
FIG. 3A through FIG. 3C show sectional views of the attachment of bulkhead door assemblies to a concrete foundation wall that illustrates embodiments of the present invention.
Figure 3B:
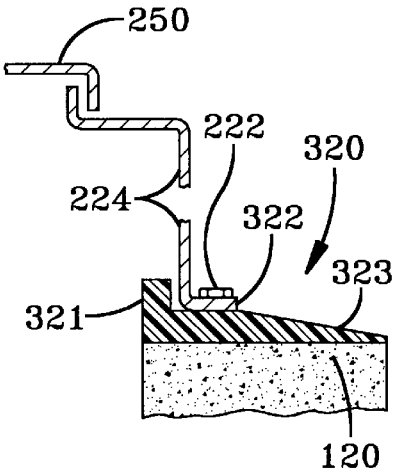
Figure 3C:
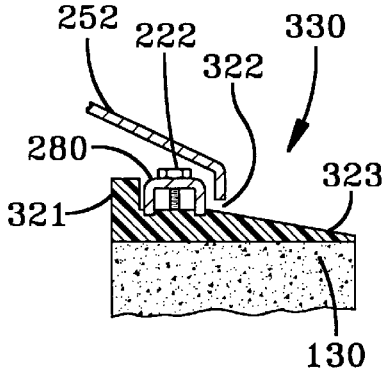

Turning now to FIG. 3A through FIG. 3C, FIG. 3A through FIG. 3C show sectional views of the attachment of bulkhead door assemblies to a concrete foundation wall that illustrates embodiments of the present invention. The sectional views show the right side bulkhead seal 320 and the front bulkhead seal 330 shaped so that there is an inside vertical lip 321, a flat attaching surface 322 and outside slope 323. FIG. 3A illustrates the right side 220 and the door 250 of the bulkhead door assembly 200 shown in FIG. 1. A side bottom flange 226 is provided for attaching the bulkhead door assembly to the foundation wall 120. Positioned between the bulkhead door assembly right side 220 and the right foundation wall 120 is a right bulkhead seal 320, a preferred embodiment of the present invention. The right bulkhead seal 320 is attached to the top of the foundation right wall 120 with an adhesive so that this interface is both airtight and water tight. The right side 220 of the door assembly is attached to the right foundation wall 120 by bolts 222 through the side bottom flange 226, located internal to the door assembly and that extend through the bulkhead seal 320 into the foundation wall 120. Because of the slope of the bulkhead seal 320 causes water to drain off the bulkhead seal 320, and the bolts 222 cause a tight fit between the door assembly right side 220 and the bulkhead seal 320, this interface is also airtight and watertight. The bulkhead door assembly left side is similarly attached to the left foundation wall through a bulkhead seal. FIG. 3B illustrates the right side 224 and door 250 of another type of bulkhead door assembly that has attachment means external to the bulkhead door assembly. Positioned between the bulkhead door assembly right side 224 and the right foundation wall 120 is a right bulkhead seal 320, a preferred embodiment of the present invention. The right bulkhead seal 320 is attached to the top of the foundation right wall 120 with an adhesive so that this interface is both airtight and watertight. The right side 224 of the door assembly is attached to the right foundation wall 120 by bolts 222 through the side bottom flange 226, located external to the door assembly and that extend through the bulkhead seal into the side foundation wall 120. Because of the slope of the bulkhead seal 320 causes water to drain off the bulkhead seal 320, and the bolts 222 cause a tight fit between the door assembly right side 224 and the bulkhead seal 320, this interface is also airtight and watertight. The bulkhead door assembly left side is similarly attached to the left foundation wall. FIG. 3C illustrates the front part of a bulkhead door assembly. A front channel 280 of the bulkhead door assembly connects the left side to the right side of the door assembly. Positioned between the front channel 280 and the front foundation wall 130 is a front bulkhead seal 330, a preferred embodiment of the present invention. The front bulkhead seal 330 is attached to the top of the foundation front wall 130 with an adhesive so that the interface is airtight and watertight. The front channel 280 is attached to the front foundation wall by bolts 222 that extend through the front bulkhead seal 330 into the front foundation wall 130. Because of the slope of the bulkhead seal 330 and the tight fit between the bulkhead seal 330 and the front channel 280, this interface is also airtight and watertight. Also illustrated in FIG. 3C is a partial section of the right door front 252 shown in the closed position.

Figure 4:
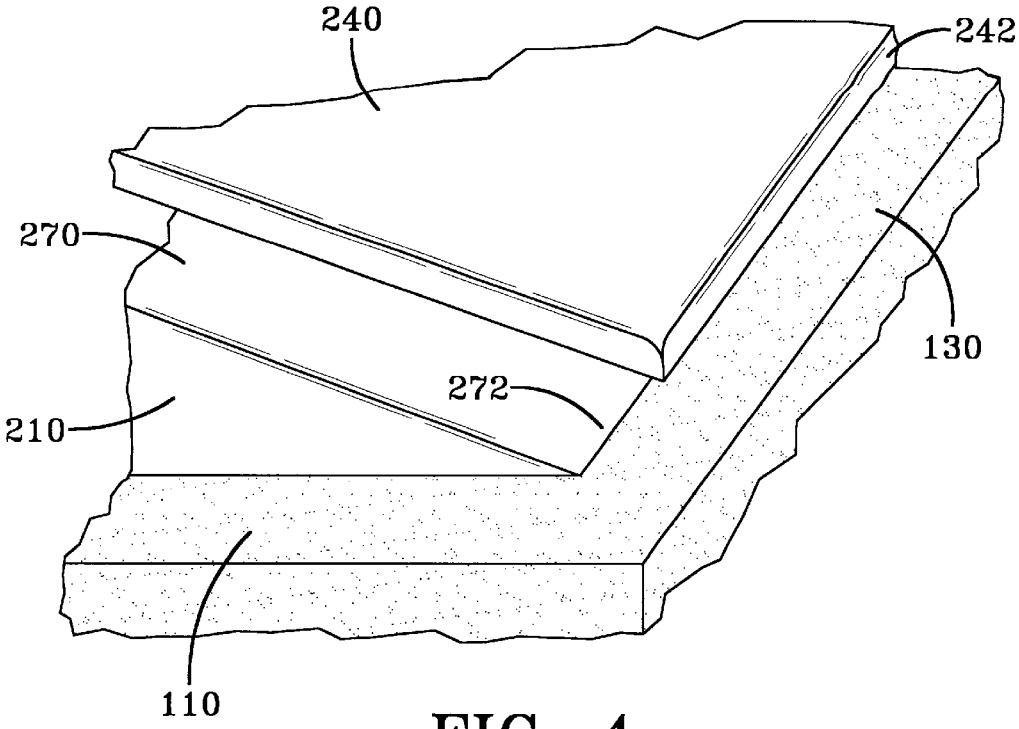
FIG. 4 shows a partial view of a comer of a bulkhead door assembly mounted to a concrete foundation wall using existing techniques.

Turning now to FIG. 4, FIG. 4 shows a partial view of a comer of a bulkhead door assembly with doors in a closed position and mounted to a concrete foundation wall using existing techniques. Illustrated in FIG. 4 is a left foundation wall 110 and a front foundation wall 130. The parts of the bulkhead door assembly illustrated in FIG. 4 include the left side 210, the top side 270, the top front 272, the left door 240, and the left door front 242.

Figure 5:
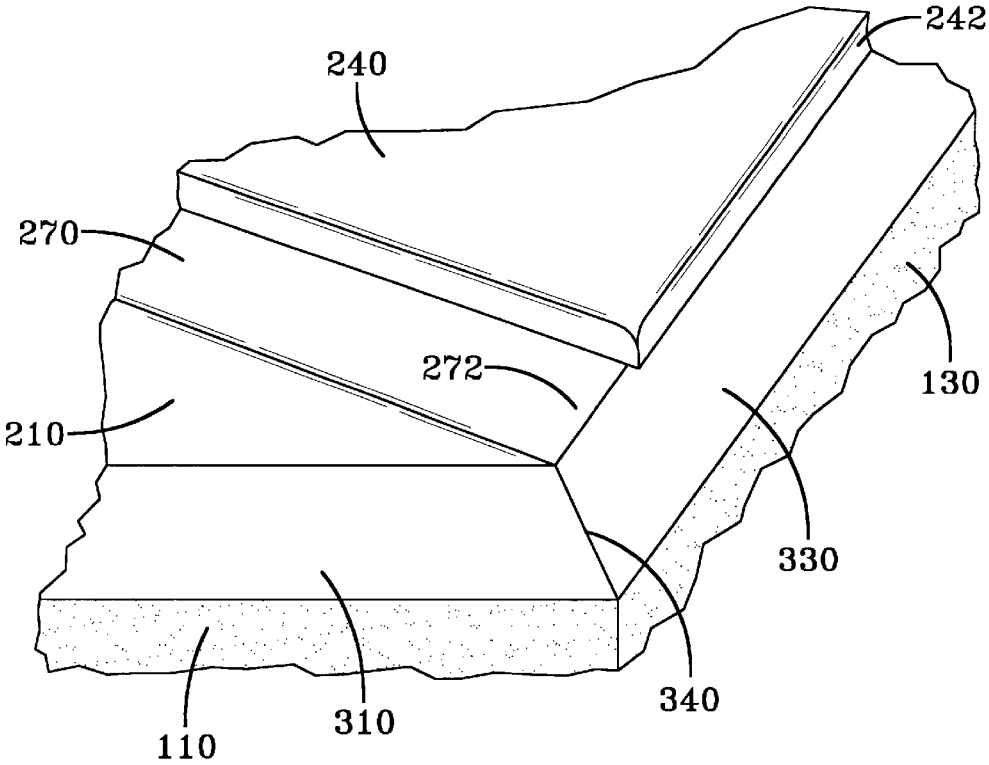
FIG. 5 shows a partial view of a comer of a bulkhead door assembly mounted to a concrete foundation wall using embodiments of the present invention.

Turning now to FIG. 5, FIG. 5 shows a partial view of a comer of a bulkhead door assembly mounted to a concrete foundation wall using embodiments of the present invention. Although these figures depict the right side of a bulkhead door assembly, the left side and front are similarly attached using the same bulkhead seal configuration. FIG. 5 illustrates a left bulkhead seal 310 attached to a left foundation wall 110 with an adhesive and a front bulkhead seal 330 attached to a front foundation wall with an adhesive. The door assembly left side 210 and the top front 272 are attached to the foundation left wall 110 and the foundation front wall 130, respectively, by bolts that are located internal to the door assembly and that extend through the bulkhead left seal 310 and front seal 330 into the foundation left wall 110 and front wall 130. The left seal 310 and the front seal 330 have been mitered at a 45° angle and attached together with a sealing adhesive at the comer 340. The right side of the bulkhead door assembly is similarly attached to the right foundation wall through a bulkhead seal.

Figure 6A:
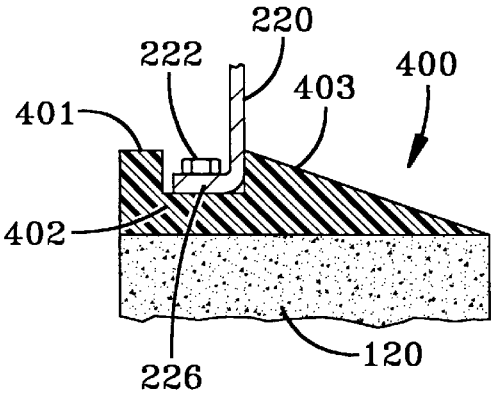
FIG. 6A through FIG. 6L show some cross-sectional variations of an embodiment of the present invention.
Figure 6B:
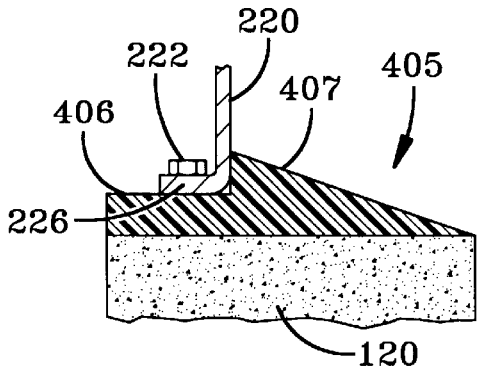
Figure 6C:
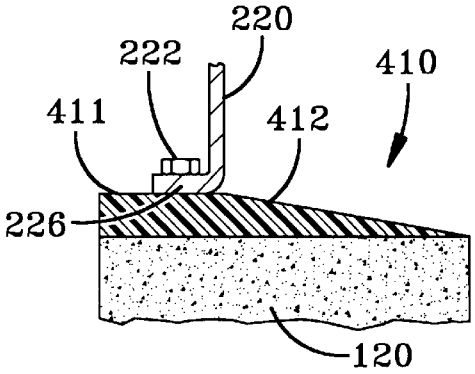
Figure 6D:
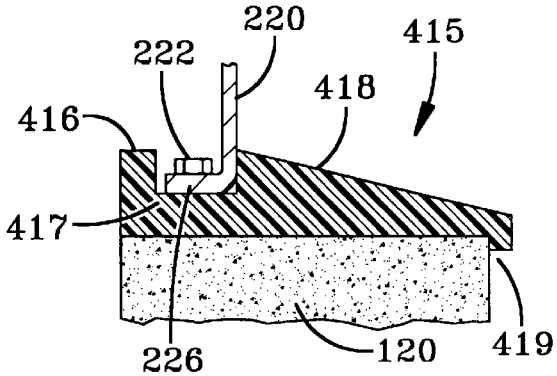
Figure 6E:
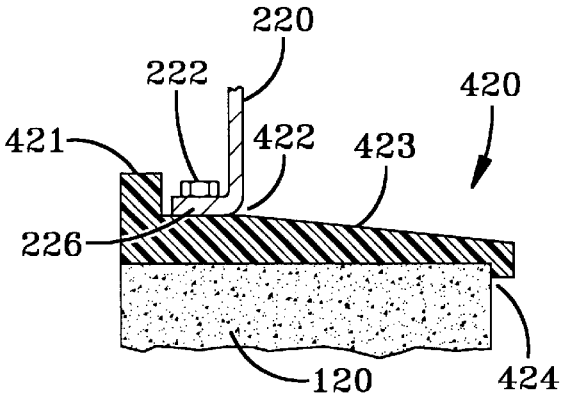
Figure 6F:
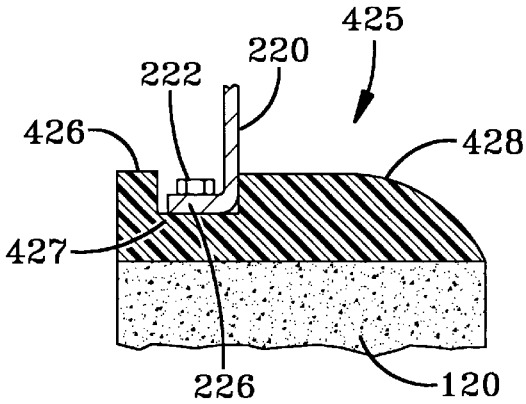
Figure 6G:
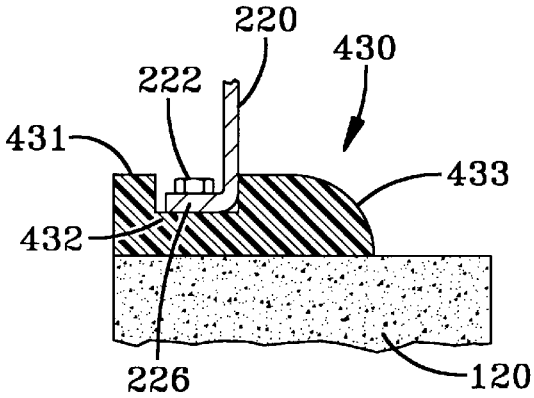
Figure 6H:
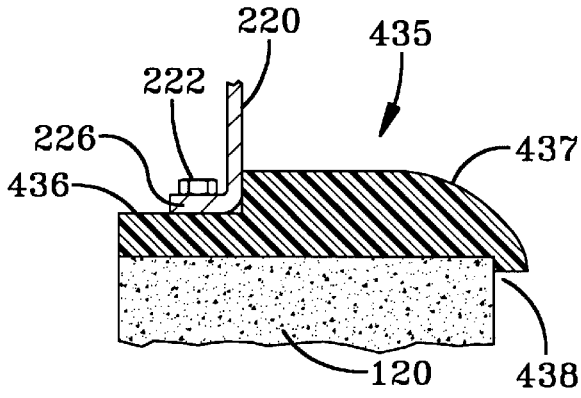
Figure 6I:
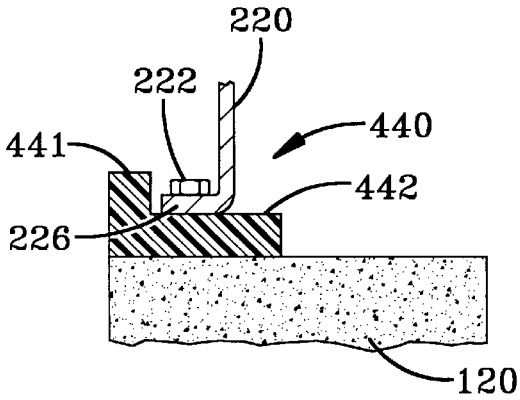
Figure 6J:
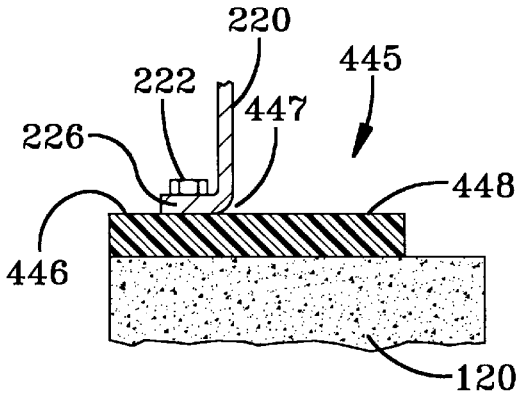
Figure 6K:
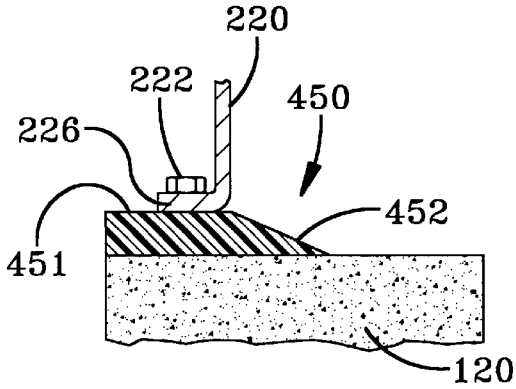
Figure 6L:
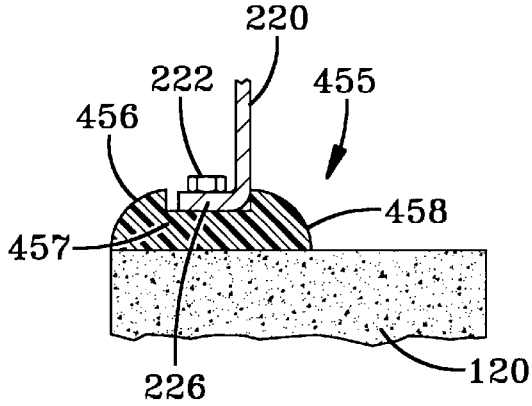

Turning now to FIG. 6A through FIG. 6L, FIG. 6A through FIG. 6L show some cross-sectional variations of an embodiment of the present invention. All of the figures depict a sectional view of a right side 220 of a bulkhead door assembly attached through a bulkhead seal to the top of a concrete foundation wall 120 by bolts 222 through the side bottom flange 226. FIG. 6A shows a bulkhead seal 400 that completely covers the top of the foundation wall 120 and has an interior lip 401, a downward sloping exterior surface 403, and a flat mounting surface 402 recessed below the interior vertical lip 401 and the exterior surface 403. FIG. 6B shows a bulkhead seal 405 that completely covers the top of the foundation wall 120 and has a downward sloping exterior surface 407 and a flat mounting surface 406 below recessed below a top of the sloping surface 405. FIG. 6C shows a bulkhead seal 410 that completely covers the top of the foundation wall 120 and has a flat top mounting surface 411, and a downward sloping exterior surface 412. FIG. 6D shows a bulkhead seal 415 that completely covers the top of the foundation wall 120 and has an interior vertical lip 416, a downward sloping exterior surface 418, a flat mounting surface 417 recessed below the top of the lip 416 and the top of the sloping surface 418, and an exterior lip 419 that extends beyond the edge of the foundation wall 120. The exterior lip 419 forms a drip edge to keep moisture away from the foundation wall 120. FIG. 6E shows a bulkhead seal 420 that completely covers the top of the foundation wall 120 and has an interior vertical lip 421, a downward sloping exterior surface 423, a flat mounting surface 422 recessed below the top of the lip 4211 and an exterior lip 424 that extends beyond the edge of the foundation wall 120. The exterior lip 424 forms a drip edge to keep moisture away from the foundation wall 120. FIG. 6F shows a bulkhead seal 425 that completely covers the top of the foundation wall 120 and has an interior vertical lip 426, a rounded downward sloping exterior surface 428, and a flat mounting surface 427 recessed below the top of the interior lip 426 and the top of the exterior surface 428. FIG. 6G shows a bulkhead seal 430 that partially covers the top of the foundation wall 120 and has an interior vertical lip 431, a rounded downward sloping exterior surface 433, and a flat mounting surface 432 recessed below the interior lip 431 and the top of the exterior surface 433. FIG. 6H shows a bulkhead seal 435 that completely covers the top of the foundation wall 120 and has a rounded downward sloping exterior surface 437, a flat mounting surface 436 recessed below the top of the exterior surface 437, and an exterior lip 438 extending beyond the edge of the foundation wall 120. The exterior lip 438 forms a drip edge to keep moisture away from the foundation wall 120. FIG. 6I shows a bulkhead seal 440 that partially covers the top of the foundation wall 120 and has an interior vertical lip 441 and a flat mounting surface 442 recessed below the interior lip 441 that extends outward from the bulkhead door assembly right side 220. FIG. 6J shows a bulkhead seal 445 that partially covers the top of the foundation wall 120 and has a rectangular cross-section, a flat interior surface 446, a flat exterior surface 448, and a flat mounting surface 447 that is coplanar with the interior surface 446 and the exterior surface 448. FIG. 6K shows a bulkhead seal 450 that partially covers the top of the foundation wall 120 and has an flat interior and mounting surface 451, and a downward sloping exterior surface 452. FIG. 6L shows a bulkhead seal 455 that partially covers the top of the foundation wall 120 and has an rounded downward sloping interior vertical lip 456, a rounded downward sloping exterior surface 458, and a flat mounting surface 457 recessed below the top of the interior lip 456 and the top of the exterior surface 458. There are many other cross-sectional configurations that may vary from those depicted, but that, nevertheless, fall within the scope of the present invention.

Figure 7A:
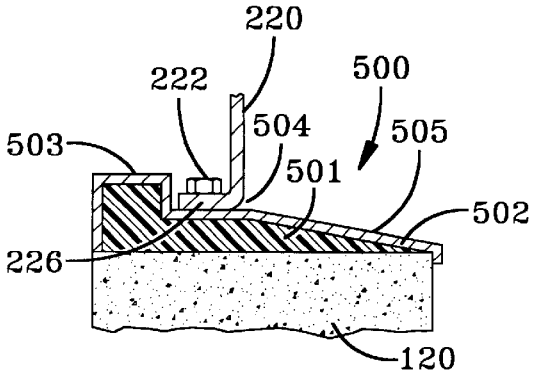
FIG. 7A through FIG. 7F show some cross-sectional variations of another embodiment of the present invention.
Figure 7B:
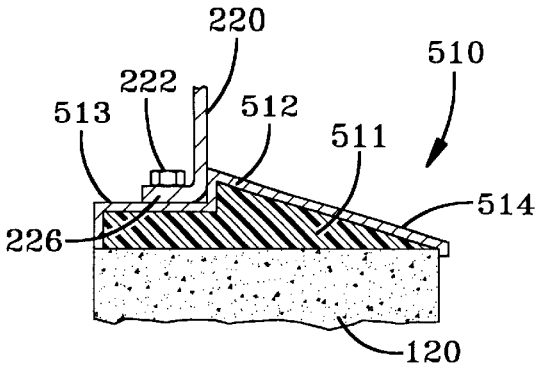
Figure 7C:
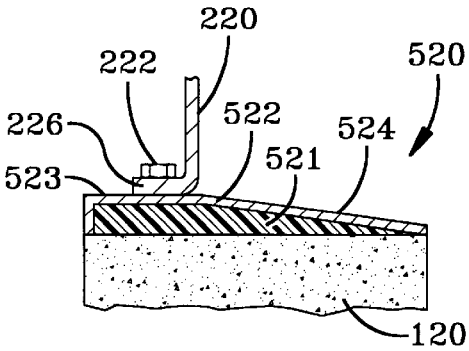
Figure 7D:
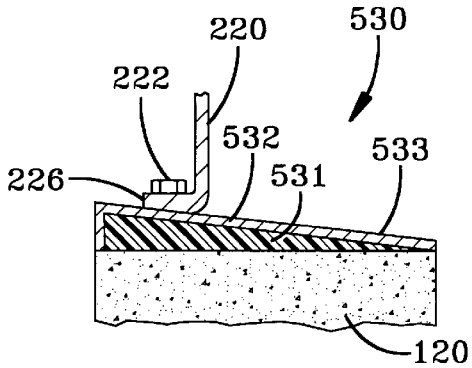
Figure 7E:
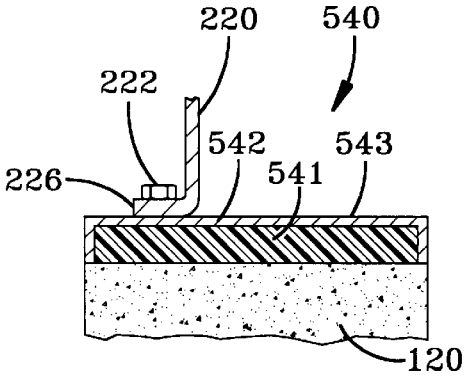
Figure 7F:
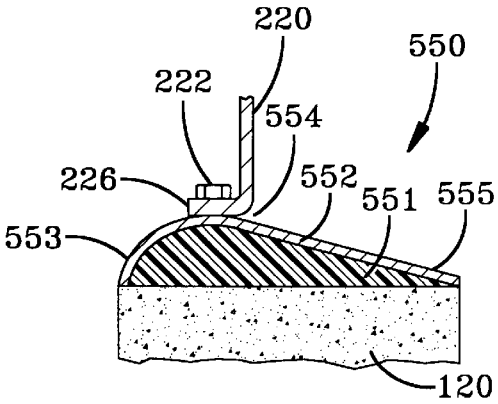

Turning now to FIG. 7A through FIG. 7F, FIG. 7A through FIG. 7F show some cross-sectional variations of another embodiment of the present invention. This embodiment includes a bulkhead seal that comprises a hard outer shell and a softer inner gasket material. Although these figures depict the right side of a bulkhead door assembly, the left side and front are similarly attached using the same bulkhead seal configuration. FIG. 7A shows a bulkhead seal 500 that completely covers the top of the foundation wall 120 and has a hard outer shell 502 and a softer inner gasket material 501. The hard outer shell 502 may be a vinyl material and the inner gasket material 501 may be neoprene. The cross-sectional shape of the bulkhead seal 500 has an interior vertical lip 503, a flat mounting surface 504 recessed below the top of the interior lip 503 for attaching a bulkhead door assembly right side 220 with bolts 222 through the side bottom flange 226, and a downward sloping exterior surface 505. FIG. 7B shows a bulkhead seal 510 that completely covers the top of the foundation wall 120 and has a hard outer shell 512 and a softer inner gasket material 511. The cross-sectional shape of the bulkhead seal 510 has a downward sloping exterior surface 514 and a flat mounting surface 513 recessed below the top of the exterior surface for attaching a bulkhead door assembly right side 220 with bolts 222. FIG. 7C shows a bulkhead seal 520 that completely covers the top of the foundation wall 120 and has a hard outer shell 522 and a softer inner gasket material 521. The cross-sectional shape of the bulkhead seal 520 has a flat mounting surface 523 for attaching a bulkhead door assembly right side 220 with bolts 222, and a downward sloping exterior surface 524. FIG. 7D shows a bulkhead seal 530 that completely covers the top of the foundation wall 120 and has a hard outer shell 532 and a softer inner gasket material 531. The cross-sectional shape of the bulkhead seal 530 has a continuous donwward sloping top surface 533 that provides an sloping interior surface, a sloping mounting surface for attaching a bulkhead door assembly right side 220 with bolts 222, and a sloping exterior surface. FIG. 7E shows a bulkhead seal 540 that completely covers the top of the foundation wall 120 and has a hard outer shell 542 and a softer inner gasket material 651. The cross-sectional shape of the bulkhead seal 540 has a flat top surface 543 that provides a flat interior surface, a flat mounting surface for attaching a bulkhead door assembly right side 220 with bolts 222, and a flat exterior surface. FIG. 7F shows a bulkhead seal 550 that completely covers the top of the foundation wall 120 and has a hard outer shell 552 and a softer inner gasket material 551. The cross-sectional shape of the bulkhead seal 550 has a rounded, downward sloping interior lip 553, a float mounting surface 554 for attaching a bulkhead door assembly right side 220 worth bolts 222, and a downward sloping exterior surface 555. There are many other cross-sectional configurations that may vary from those depicted, but that, nevertheless, fall within the scope of the present invention.

Figure 8A:
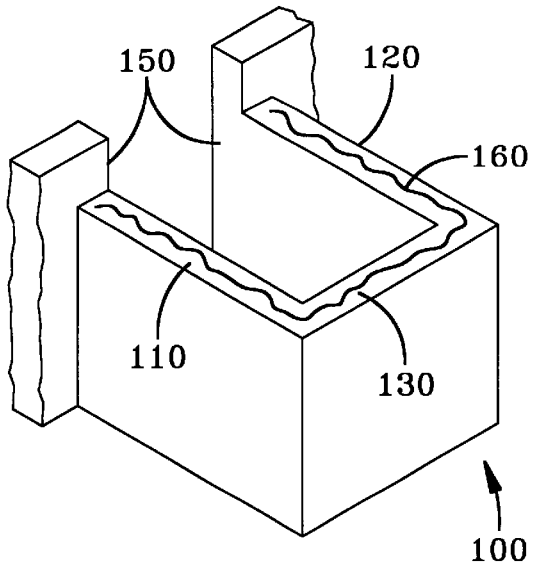
FIG. 8A through FIG. 8C show the steps of installing a bulkhead door assembly on a concrete foundation wall using embodiment of the present invention.
Figure 8B:
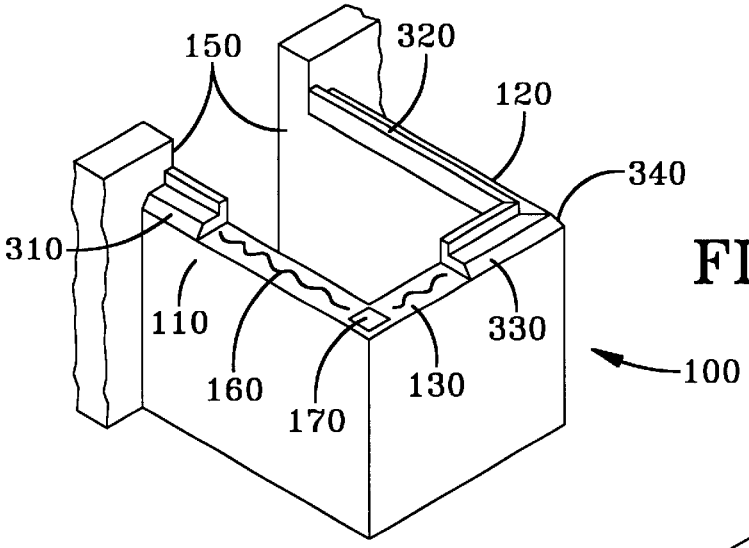
Figure 8C:
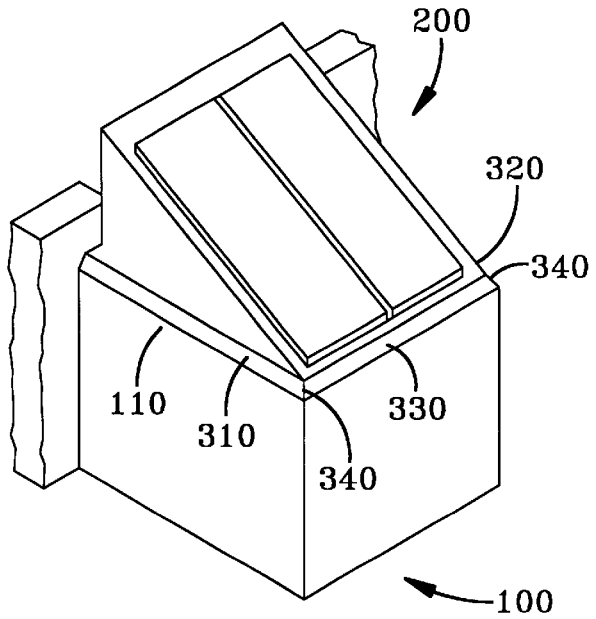

Turning now to FIG. 8A through FIG. 8C, FIG. 8A through FIG. 8C show the steps of installing a bulkhead door assembly on a concrete foundation wall using embodiments of the present invention. FIG. 8A shows a section of a concrete foundation wall 100 for providing access to a basement of a building. An opening in the foundation wall 150 that supports the building is enclosed by a left foundation wall 110 a front foundation wall 130, and a right foundation wall 120. A stairway is normally mounted within space enclosed by these foundation walls to provide access to the basement. The tops of the foundation walls 110, 120, 130 are cleaned and an adhesive 160 is spread evenly over the top surfaces. FIG. 8B shows a left bulkhead seal 310 attached to the top of the left foundation wall 110 with adhesive 160, a right bulkhead seal 320 attached to the top of the right foundation wall 120 with adhesive 160, and a front bulkhead seal 330 attached to the top of the front foundation wall 130 with adhesive 160. Prior to attachment to the foundation walls, the bulkhead seals are delivered to the construction site in the form of long strips. After measuring the length dimension of the tops of the left foundation wall 110, the right foundation wall 120, and the front foundation wall 130, the bulkhead seal strips are cut to appropriate length, mitered at a 45° angle at the comer positions, and positioned on the adhesive 160 on the tops of the foundation walls, as shown in FIG. 8B. Comer adhesive strips 170 positioned at the comers on top of the foundation walls prior to installing the bulkhead seals provide tighter comer connection between the mitered comers of the bulkhead seals. FIG. 8C shows a bulkhead door assembly 200 installed over the bulkhead seals 310, 320, 330. The mitered comers 340 are sealed with an adhesive to provide an airtight and watertight connection. Bolt holes are drilled through the bulkhead seals and into the foundation wall tops at predetermined hole positions in the bulkhead door front and sides, and expansion bolts are installed to secure the bulkhead door assembly 200 tightly to the foundation wall 100. This provides an airtight and watertight seal between the bulkhead door assembly 200 and the foundation wall 100.

Although the present invention has been described in considerable detail with reference to certain preferred embodiments thereof, other embodiments are possible. Therefore, the spirit and scope of the appended claims should not be limited to the description of the preferred embodiments herein.

What is claimed is:

1. A bulkhead door assembly having a seal, said assembly comprising:

(a) a concrete foundation wall having a top and a width dimension;

(b) the bulkhead door assembly having a side bottom flange and a front channel that are secured to the concrete foundation wall;

(c) an elongated strip of semi-flexible material having a top surface, a bottom surface, and a thickness;

(d) the bottom surface being substantially flat, and being adhesively attached to the top of the concrete foundation wall;

(e) the top surface having a shape mating with the side bottom flange and the front channel of the bulkhead door assembly; and (f) the thickness being adapted to compress when the side bottom flange and the front channel of the bulkhead door assembly are secured by an attachment means to the concrete foundation wall, wherein the shape of the top surface includes a downward sloping surface for draining moisture away from the bulkhead door assembly, the downwardsloping surface being exterior to the side bottom flange and the front channel of the bulkhead door assembly.

2. A bulkhead door assembly having a seal, according to claim 1, wherein the elongated strip is cut to predetermined lengths to match perimeter dimensions of the side bottom flange and the front channel of the bulkhead door assembly.

3. A bulkhead door assembly having a seal, according to claim 2, wherein mitered comers are formed where cut ends of the elongated strips meet at right angles.

4. A bulkhead door assembly having a seal, according to claim 3, wherein the formed mitered corners are sealed with an seal adhesive.

5. A bulkhead door assembly having a seal, according to claim 1, wherein the elongated strip has a width dimension that is substantially less than a width dimension of the foundation wall.

6. A bulkhead door assembly having a seal, according to claim 1, wherein the elongated strip has a width dimension that is approximately equal to a width dimension of the concrete foundation wall.

7. A bulkhead door assembly having a seal, according to claim 1, wherein the elongated strip has a width dimension that is greater than a width dimension of the foundation wall for providing a drip edge that extends beyond the edge of the foundation wall.

8. A bulkhead door assembly having a seal, according to claim 1, wherein the adhesive attachment of the bottom surface to the top of the foundation wall forms an airtight and watertight seal.

9. A bulkhead door assembly having a seal, according to claim 1, wherein the top surface has a flat surface for mating with the side bottom flange and the front channel of the bulkhead door assembly.

10. A bulkhead door assembly having a seal, according to claim 1, wherein the top surface is flexibly mated with the side bottom flange and the front channel of the bulkhead door assembly.

11. A bulkhead door assembly having a seal, according to claim 1, wherein the mating of the side bottom flange and the front channel forms an airtight and a watertight seal.

12. A bulkhead door assembly having a seal, according to claim 1, wherein the shape of the top surface includes a vertical lip for blocking moisture seepage, the vertical lip being interior to the side bottom flange and the front channel of the bulkhead door assembly.

13. A bulkhead door assembly having a seal, according to claim 1, wherein the top surface mating with the side bottom flange and the front channel is recessed from the top of the downward sloping surface.

* * * * *